US006625996B2

(12) United States Patent
Nakajima et al.

(10) Patent No.: US 6,625,996 B2
(45) Date of Patent: Sep. 30, 2003

(54) COMMUNICATION CONTROL SYSTEM FOR AIR CONDITIONER

(75) Inventors: Seiji Nakajima, Ota (JP); Takaharu Tenma, Oizumi-machi (JP); Eiji Oohashi, Oizumi-machi (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 09/839,505

(22) Filed: Apr. 20, 2001

(65) Prior Publication Data

US 2001/0032474 A1 Oct. 25, 2001

(30) Foreign Application Priority Data

Apr. 24, 2000 (JP) ..... 2000-122524

(51) Int. Cl.[7] ..... F25B 49/02
(52) U.S. Cl. ..... 62/175; 62/230; 236/51
(58) Field of Search ..... 62/175, 230, 203; 236/51; 165/205, 207, 208, 209

(56) References Cited

U.S. PATENT DOCUMENTS

| | | | | |
|---|---|---|---|---|
| 4,362,270 A | * | 12/1982 | Cleary et al. | 236/51 X |
| 4,682,648 A | * | 7/1987 | Fried | 236/51 X |
| 5,089,974 A | | 2/1992 | Demeyer et al. | 364/492 |
| 5,400,017 A | | 3/1995 | Yoshisaka et al. | 340/825.06 |
| 5,853,123 A | * | 12/1998 | Okano et al. | 62/175 X |

FOREIGN PATENT DOCUMENTS

| | | | |
|---|---|---|---|
| DE | 2719813 A1 | 11/1978 | H04B/3/54 |
| EP | 0738096 A1 | 10/1996 | H04Q/9/00 |
| JP | 56155326 | 12/1981 | F24F/11/02 |
| JP | 57108536 | 8/1982 | R24F/11/02 |
| JP | 08251680 | 9/1996 | H04Q/9/14 |

OTHER PUBLICATIONS

European Search Report Application No. EP 01 109870 issued Sep. 24, 2002.

* cited by examiner

*Primary Examiner*—Harry B. Tanner
(74) *Attorney, Agent, or Firm*—Darby & Darby

(57) ABSTRACT

In a communication control system for an air conditioner including an outdoor unit, plural indoor units and control equipment such as a remote controller, etc. which is connected to each indoor unit through a communication line, data communication being carried out between each indoor unit and the control equipment through the communication line, each indoor unit is equipped with a communication control device having a power source circuit 59 to which a power source voltage is supplied from a main power source, a communication superposing circuit for superposing communication data on the power source voltage, a transistor 54 for ON/OFF-controlling the supply of the power source voltage from the main power source to the communication superposing circuit, and a polarity coincidence circuit 63A that passes the output of the communication superposing circuit therethrough to the communication line and depolarizes the power source voltage from the external. Even when an indoor unit functioning as a power supply source cannot supply power due to some trouble, another indoor unit is automatically selected as a power supply source so that the power supply operation can be continuously carried out in the air conditioner.

14 Claims, 5 Drawing Sheets

COMMUNICATION CONTROL SYSTEM FOR AIR CONDITIONER

BACKGROUND OF THE INVENTION

1. Field of the Invention

The present invention relates to a communication controller, and more particularly to a technique for a communication control system.

2. Description of the Related Art

There has been known a communication control system for an air conditioner in which plural units (for example, outdoor units, indoor units, a remote controller for setting operating environments of these units, etc.) are connected to one another through a pair of control signal lines to transmit/receive communication data among these units through the pair of control signal lines, and also power supply from a unit having a DC power source to a unit having no DC power is carried out through the pair of control signal lines (Japanese Laid-open Patent Application No. Sho-56-155326). According to this type of air conditioner, the pair of control signal lines for connecting the units to one another functions not only as a communication line through which communication data formed of tone burst signals are transmitted/received, but also as a power supply line for supplying power.

Further, in order to avoid occurrence of troubles due to failure of a wiring work or the like, any unit having no DC power source is provided with a circuit for depolarizing the polarity of signals supplied thereto. Accordingly, the non-polarized and bi-directional data communication can be performed while the power supply is carried out from a unit having a DC power source to a unit having no DC power source.

Since the above conventional communication control system uses tone burst signals as communication signals for data communication between units, a high frequency circuit for tone burst signals must be equipped to each unit, and thus the circuit construction is very complicated. In order to solve this problem, a communication controller for an air conditioner that needs no high frequency circuit for tone burst signals has been proposed (Japanese Laid-open Patent Application No. Hei-8-251680).

The communication controller for the air conditioner disclosed in the above publication is shown in FIG. 1.

In this communication controller, a master unit 1 that is connected to the main body 3 of an air conditioner and equipped with a power source and a monitoring controller for controlling the monitoring of the air conditioner is connected to plural slave units 2 through a pair of control signals (communication lines) 4, and each of the master unit 1 and the slave units 2 is equipped with a signal polarity incidence circuit (signal depolarizing circuit) comprising bridged diodes to make the signals of these units coincident in polarity.

The master unit 1 is equipped with a device for superposing an ON/OFF signal (communication signal) having a predetermined amplitude level on a predetermined DC voltage level under the control of the monitoring controller and then transmitting the superposed signal thus obtained to the communication line 4, and also receiving signals from each slave unit 2 through the signal polarity coincidence circuit. Further, each slave unit 2 is equipped with a device for receiving the superposed signal from the master unit through the signal polarity coincidence circuit, separating the superposed signal into the ON/OFF signal having the predetermined amplitude level and the DC voltage having the predetermined level which will be used as a power source for the slave unit concerned, and also transmitting an ON/OFF signal having a predetermined amplitude level under the control of a controller through the signal polarity coincidence circuit to the master unit.

Accordingly, in the communication controller described above, the communication line is also used as the power supply line and the non-polarized and bi-directional communication data can be transmitted/received between the master unit 1 and each slave unit 2 without using any high frequency circuit for tone burst signals while the power supply is carried out from the master unit 1 to each slave unit 2.

In the conventional communication controller disclosed in the Japanese Laid-open Patent Application No. Hei-8-251680, a power supply source having a power source must be determined and fixed in advance (in this case, the master unit is set and fixed as the power supply source). Therefore, when various individual systems are required to be established in accordance with users' requirements, the system construction and the circuit construction must be changed every time. Further, when the master unit serving as the power supply source is disabled due to some trouble, the power supply to the slave units is stopped and thus the system itself must be stopped. In addition, it is impossible to supply power to the slave units until the master unit is completely repaired or a work of exchanging it with a new one is completed, and this is a critical obstruction to the operation of the system.

SUMMARY OF THE INVENTION

Therefore, the present invention has been implemented in view of the foregoing problems of the prior arts, and has an object to provide a communication control system for an air conditioner which enables a system construction satisfying various users' requirements with a simple circuit construction and in low cost.

Another object of the present invention is to provide a communication control system for an air conditioner in which even when power supply is stopped due to short-circuiting of a communication line, failure of a power supply source or the like, another power supply source is automatically selected and thus the operation of the air conditioning system can be continuously carried out.

In order to attain the above objects, according to the present invention, a communication control system for an air conditioner including at least one outdoor unit, plural indoor units and control equipment such as a remote controller, etc. which are connected to one another through a communication line to mutually carry out data communication through the communication line, is characterized in that at least two indoor units of the plural indoor units are equipped with power supply means, and non-polarized and bi-directional data communication is carried out between the plural indoor units and the control equipment while the power supply means of any one of the at least two indoor units supplies a power source voltage of a main power source to the communication line to the control equipment.

In the communication control system, the power supply means includes a communication superposing unit for superposing communication data on the power source voltage, a switching unit for ON/OFF-controlling the supply of the power source voltage from the main power source to the communication superposing unit, and a polarity coincidence unit for passing therethrough the output of the communication superposing unit to the communication line and depolarizing the power source voltage through the communication line from another indoor unit functioning as a power supply source.

In the communication control system, the communication superposing unit includes a transistor to which ON/OFF signals of communication signals are input, and at least two resistors that are connected to each other in series and divides the power source voltage from the main power source in accordance with the ON/OFF operation of the transistor to superpose the communication signals on the power source voltage.

In the communication control system, the switching unit is disposed between the main power source and the communication superposing unit, and equipped with a transistor for ON/OFF-controlling the supply of the power source voltage from the main power source to the communication superposing unit on the basis of the ON/OFF operation thereof.

In the communication control system, the polarity coincidence unit includes bridged diodes for converting the polarity of signals from the external, and a transistor for bypassing the output signal of the communication superposing unit without passing the output signal through the bridged diodes.

In the communication control system, the power supply unit further includes a voltage detecting unit for detecting the power source voltage in the communication superposing unit.

In the communication control system, the voltage detecting unit includes at least two resistors connected in series, and a transistor connected to the connection point of the two resistors, the power source voltage being applied to one terminal of one of the two resistors at the opposite side to the connection point while one terminal of the other resistors at the opposite side to the connection point is grounded, and the power source voltage being detected on the basis of the ON/OFF operation of the transistor which is switched on/off on the basis of the voltage at the connection point of the two resistors.

In the communication control system, the power supply unit further includes an over-current detecting unit that is disposed between the switching unit and the communication superposing unit and detects the variation of the power source voltage applied to the communication superposing unit to detect short-circuiting of the communication line.

In the communication control system, the over-current detecting unit includes at least one resistor, and a transistor which is switched on/off on the basis of the voltage applied to both the ends of the resistor, a voltage value applied to both the end of the resistor being varied in accordance with the variation of the power source voltage, and the transistor being switched on/off when the voltage value exceeds a predetermined voltage value, thereby detecting the short-circuiting of the communication line.

In the communication control system, the power supply means includes a voltage detecting unit for detecting the power source voltage on the communication line, and a logical unit for judging on the basis of the detection result of the voltage detecting unit whether there is another power supply source which supplies the power source voltage onto the communication line and setting itself to function as a power supply source if it is judged that no other power supply source exists.

In the communication control system, the power supply means includes a detection unit for detecting simultaneous application of a negative-phase power source voltage from another indoor unit functioning as a power supply source onto the communication line or short-circuiting of the communication line, and then stopping the supply of the power source voltage if the simultaneous application of the negative-phase power source voltage from the other indoor unit is detected.

In the communication control system, the power supply means resumes the supply of the power source voltage after the supply of the power source voltage is stopped.

In the communication control system, the power supply means further includes a logical unit for logically judging it on the basis of communication data transmitted through the communication line whether the supply of the power source voltage is stopped or not when another indoor unit functioning as a power supply source supplies an in-phase power source voltage.

In the communication control system, the power supply means of each of the at least two indoor units is equipped with self-selecting means for automatically selecting itself as a power supply source for supplying the power source voltage to the communication line.

According to the present invention, a communication control system including plural first units each having a power supply function of supplying a power source voltage and at least one second unit having no power supply function which are connected to one another through a communication line and through which the power source voltage and communication data are transmitted/received in a non-polarized and bi-directional style through the communication line among the first and second units, is characterized in that each of the first units has a voltage detecting unit for detecting whether the power source voltage exists on the communication line after a main power source is switched on, and a power source voltage judging and supplying unit for making itself function as a power supply source to supply the power source voltage to the communication line if it is judged by the voltage detecting unit that no power source voltage exists on the communication line after a first predetermined time elapses from the switch-on time of the main power source.

In the communication control system, each of the first units further includes a power supply stop unit for stopping the supply of the power supply voltage if it is judged that no power source voltage still exists on the communication line after a second predetermined time longer than the first predetermined time elapses.

According to the present invention, a communication control system for an air conditioner including plural indoor units and at least one outdoor unit, each indoor unit and control equipment containing a remote controller being connected to each other through a communication line, is characterized in that all the indoor units and the control equipment perform non-polarized and bi-directional data communication while a power source voltage is applied from any one of the plural indoor units to the control equipment.

DETAILED DESCRIPTION OF THE PREFERRED EMBODIMENTS

Preferred embodiments according to the present invention will be described hereunder with reference to the accompanying drawings.

Figure 2:
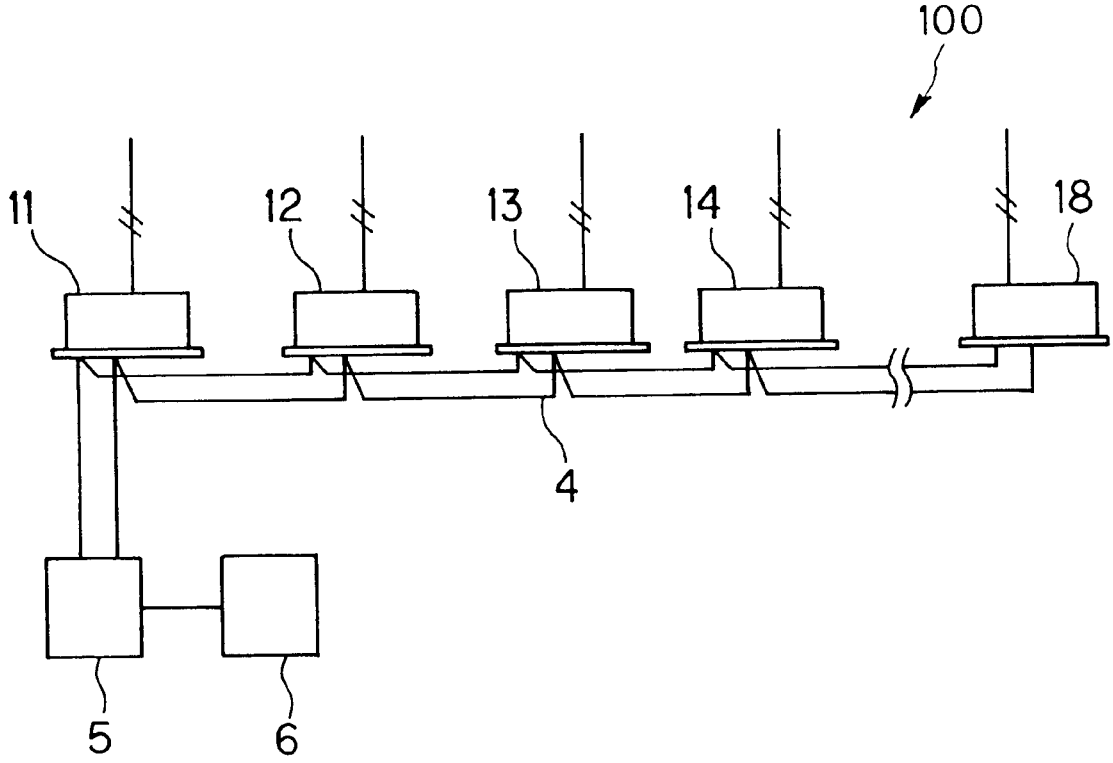
FIG. 2 is a diagram showing the arrangement of constituent elements of an air conditioning system according to the present invention.

FIG. 2 is a schematic diagram showing the arrangement of constituent elements of an air conditioning system according to an embodiment of the present invention.

An air conditioning system 100 shown in FIG. 2 includes an outdoor unit (not shown), plural indoor units 11 to 18, a remote controller 5, a central controller 6. Particularly, the indoor units 11 to 18, the remote controller 5 and the central controller 6 are connected to one another through a communication line 4. The communication line 4 comprises a pair of communication lines, and not only communication signals (control signals), but also power is transmitted/received through the communication line 4. That is, the communication line 4 is also used as a power supply line. Each indoor unit is designed to carry out power supply to the communication line 4 (that is, it is equipped with a power supply circuit).

In the following description, it is assumed that all the indoor units have the power supply function. However, it is not necessarily required that all the indoor units have the power supply function, and the same effect of the present invention can be obtained insofar as plural (two or more) indoor units have the power supply function. Further, each indoor unit and the outdoor unit (not shown) are connected to each other through the communication line 4 or another communication line.

Here, neither the remote controller 5 nor the central controller 6 cannot receive power from a main power by itself, and it receives power from any outdoor unit through the communication line 4 connected to the plural indoor units 11 to 18. That is, neither the remote controller 5 nor the central controller 6 has no power supply function. Further, a user instructs the start/stop of the operation of the outdoor unit 10 and the indoor units 11 to 18 or sets the operating conditions to the remote controller 5 or the central controller 6, and these information is transmitted from the remote controller 5 or the central controller 6 through the communication line 4 to the outdoor unit 10 and the indoor units 11 to 18. Further, information on the present operating conditions is transmitted from the outdoor unit 10 and the indoor units 11 to 18 to the to the remote controller 5 and the central controller 6. That is, the communication line 4 is designed so that communication data can be bidirectionally transmitted among the outdoor unit, the indoor units, the remote controller, the central controller, etc. (that is, the bi-directional data communication can be performed).

Figure 3:
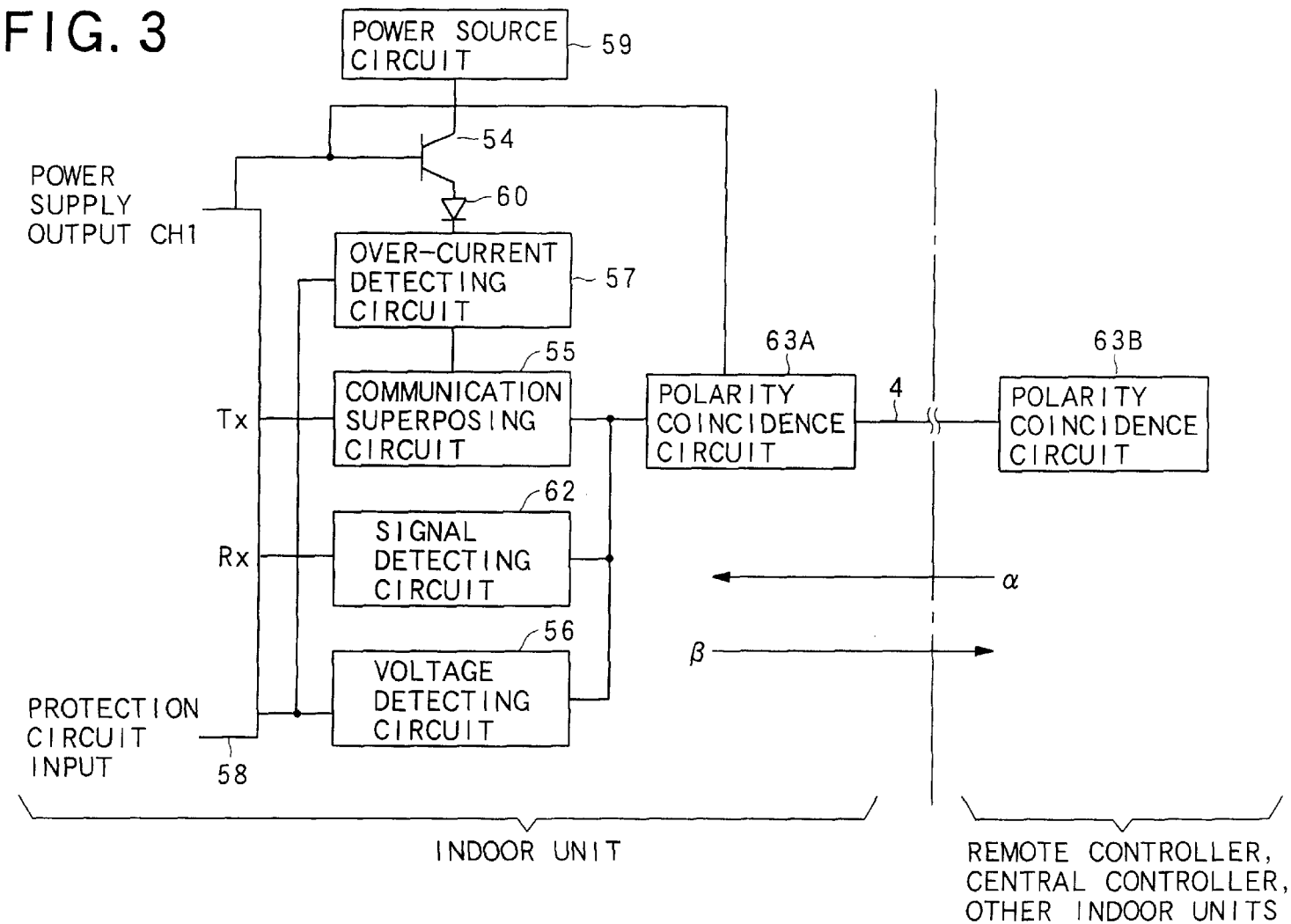
FIG. 3 is a diagram showing an embodiment of a communication controller used in an air conditioning system according to the present invention.

FIG. 3 is a diagram showing the basic construction of a communication controller of each indoor unit (power supply source) according to the embodiment of the present invention. In this embodiment, all the indoor units function as power supply sources and thus each of the indoor units is uniformly equipped with the same communication controller shown in FIG. 3.

The circuit arrangement at the left side of FIG. 3 with respect to the one-dotted chain line corresponds to the communication controller of any indoor unit functioning (or not functioning) as a power supply source, and the circuit arrangement at the right side of FIG. 3 corresponds to the other indoor units functioning (not functioning) as a power supply source, the remote controller 5 and the central controller 6. In FIG. 3, only a polarity incidence circuit (signal depolarizing circuit) 63B equipped to each of the other indoor units, the remote controller 5 and the central controller 6 is illustrated at the right side of FIG. 3 in order to simplify the illustration.

The communication controller shown in FIG. 3 includes a power source circuit 59 connected to a main power source (not shown), an over-current detecting circuit 57 connected to the power source circuit through a transistor 54 and a diode 60 (serving as a switching circuit), a communication superposing circuit 55 connected to both the over-current detecting circuit 57 and the communication port (output side) Tx of a microcomputer 58, a signal detecting circuit 62 connected to the communication port (input side) Rx of the microcomputer 58, a voltage detecting circuit 56 connected to a protection circuit input of the microcomputer 58, and a polarity coincidence circuit 63A connected to the power supply output CH1 of the microcomputer 58, the communication superposing circuit 55, the signal detecting circuit 62 and the voltage detecting circuit 56.

The other indoor units having the power supply function are equipped with the same communication controller as shown in FIG. 3. However, the remote controller 3 and the central controller 4 (and indoor units having no power supply function) have no circuit relating to the power supply function, and each of these controllers (and the indoor units) is equipped with a circuit relating to signal communication (transmission/reception), a polarity coincidence circuit 63B directly connected to the communication line 4 and other required controller, etc. The polarity coincidence circuit 63A is connected to the polarity coincidence circuit 63B of each of the other indoor units, the remote controller and the central controller through the communication line 4, whereby the indoor units 11 to 18, the remote controller 5 and the central controller 6 mutually carry out the non-polarized and bi-directional communication.

As described later, on the basis of the signal level of the output signals from the voltage detecting circuit 56 and the over-current detecting circuit 57 (the signal level at the input terminal (protection circuit input) of the microcomputer of FIG. 3) and the output signal level at the power supply output terminal CH1, the microcomputer 58 of any indoor unit judges whether the indoor unit concerned receives power supply from another indoor unit. If the indoor unit concerned judges through a logical circuit that the indoor unit concerned receives no power supply from another indoor unit, the indoor unit concerned automatically sets itself to a power supply source to supply power onto the communication line 4. That is, each indoor unit is provided with a logical circuit for limiting a power supply source to any one of the indoor units. Each of the control equipment such as the remote controller and the central controller (and the indoor units having no power supply function) utilizes the power (power source voltage) on the communication line 4 as power for itself.

Further, as described later, the voltage detecting circuit 56 and the over-current detecting circuit 57 are used to detect short-circuiting of the communication line, simultaneous application of negative(inverse)-phase power source voltages from plural indoor units, etc., and the ON/OFF operation of the transistor 54 connected to the power supply output terminal CH1 is controlled on the basis of the signals from the above circuits 56 and 57 to control the start/stop of the power supply operation of each indoor unit.

Figure 4:
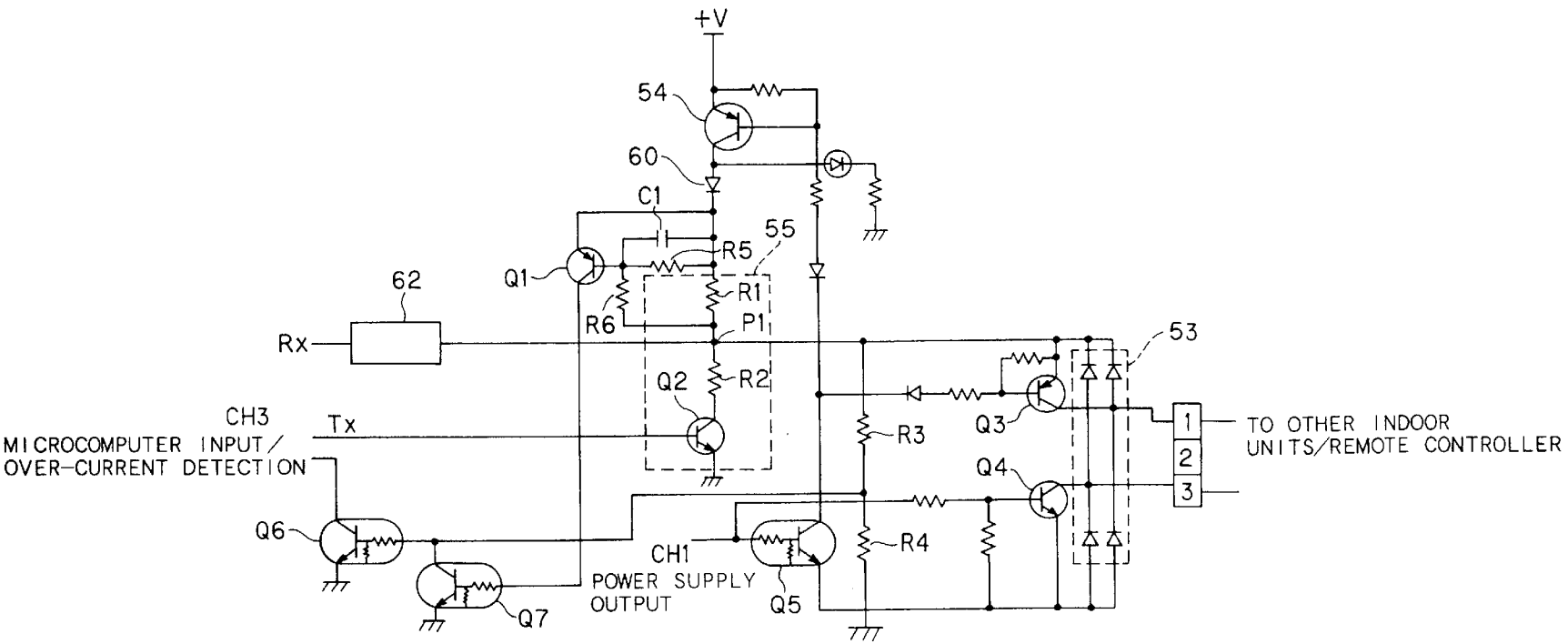
FIG. 4 is a specific circuit diagram showing the communication controller shown in FIG. 3.

When an indoor unit serving as a power supply source supplies a power source voltage from the communication controller thereof as shown in FIG. 3, an ON signal (a signal having a predetermined level at which the transistor Q5 shown in FIG. 4 is switched on) is output to the transistor Q5 to switch on the transistor 54, whereby the power source voltage from the main power source is supplied through the power source circuit 59 to the communication superposing circuit 55. The power source voltage is further supplied to the polarity coincidence circuit 63A, and fed through the communication line to the polarity coincidence circuits 63B of the other equipment. Further, when the indoor unit serving as the power supply source transmits communication data to the other equipment while superposing the communication data on the power source voltage, an ON/OFF signal (communication signal) is supplied from the communication port (output side) Tx of the microcomputer 58 to the communication superposing circuit 55 to be superposed on the power source voltage. The communication data thus superposed on the power source voltage is output to the polarity coincidence circuit 63A and further supplied through the communication line 4 to the polarity coincidence circuits 63B of the other equipment.

In the other equipment, the communication data thus transmitted are detected by the signal detecting circuit 62, and then output to the input communication port Rx of the microcomputer 58. Accordingly, the indoor unit concerned can perform the non-polarized and bi-directional communication data with the other equipment while supplying power to the other equipment.

With respect to the indoor units each of which does not serve as a power supply source, the power supply output CH1 has an OFF signal (which corresponds to no signal or a signal at the level of which the transistor Q5 is under OFF state) at all times. Therefore, the transistor 54 is also under OFF state, and no power source voltage is supplied from the power source circuit 59 to the communication superposing circuit 55. Accordingly, only the communication signal (ON/OFF signal) from the microcomputer 58 is supplied to the communication superposing circuit 55 (and superposed on the voltage power source supplied from another indoor unit), and then transmitted through the polarity coincidence circuit 63A and the communication line 4 to the polarity coincidence circuits 63B of the other equipment. Accordingly, the indoor unit concerned can perform the non-polarized and bi-directional data communication with the other equipment.

On the other hand, when the communication controller of the indoor unit receives communication signals from another equipment, the communication signals are input through the polarity coincidence circuit 63A to the signal detecting circuit 52 to be subjected to predetermined signal processing, and then supplied to the communication port (input side) Rx of the microcomputer 58. Accordingly, the communication controller of the indoor unit can perform the non-polarized and bi-directional data communication with the other equipment.

Here, it is assumed that any indoor unit is supplied with power (power supply voltage) from another indoor unit functioning as a power supply source (there are two cases: a case where the indoor unit concerned also functions as a power supply source and a case where the indoor unit concerned does not function as a power supply source). In the conventional communication controller shown in FIG. 1 (disclosed in Japanese Laid-open Patent Application No. Hei-8-251680, for example), the polarity coincidence circuit is constructed by bridged diodes, and thus the power supply from the indoor unit concerned to the communication line 4 (the other equipment) is impossible although the power supply from the external equipment into the indoor unit concerned is possible. Accordingly, in the conventional communication controller, only the master unit 1 serving as the power supply source is designed so that the polarity coincidence circuit is disposed in parallel to the power source (that is, the power is supplied from the master unit 1 to the communication line 4 (the external) without passing through the polarity coincidence circuit). On the other hand, the polarity coincidence circuit of each slave unit which receives power supply is connected to the power source of the master unit 1 through the communication line 4 in series, whereby the power supply from the master unit 1 to the slave units 2 is performed. That is, in the case of the communication controller shown in FIG. 1, the power supply source must be predetermined and fixed from the viewpoint of the circuit construction, and thus the power supply source cannot be freely selected.

Figure 1:
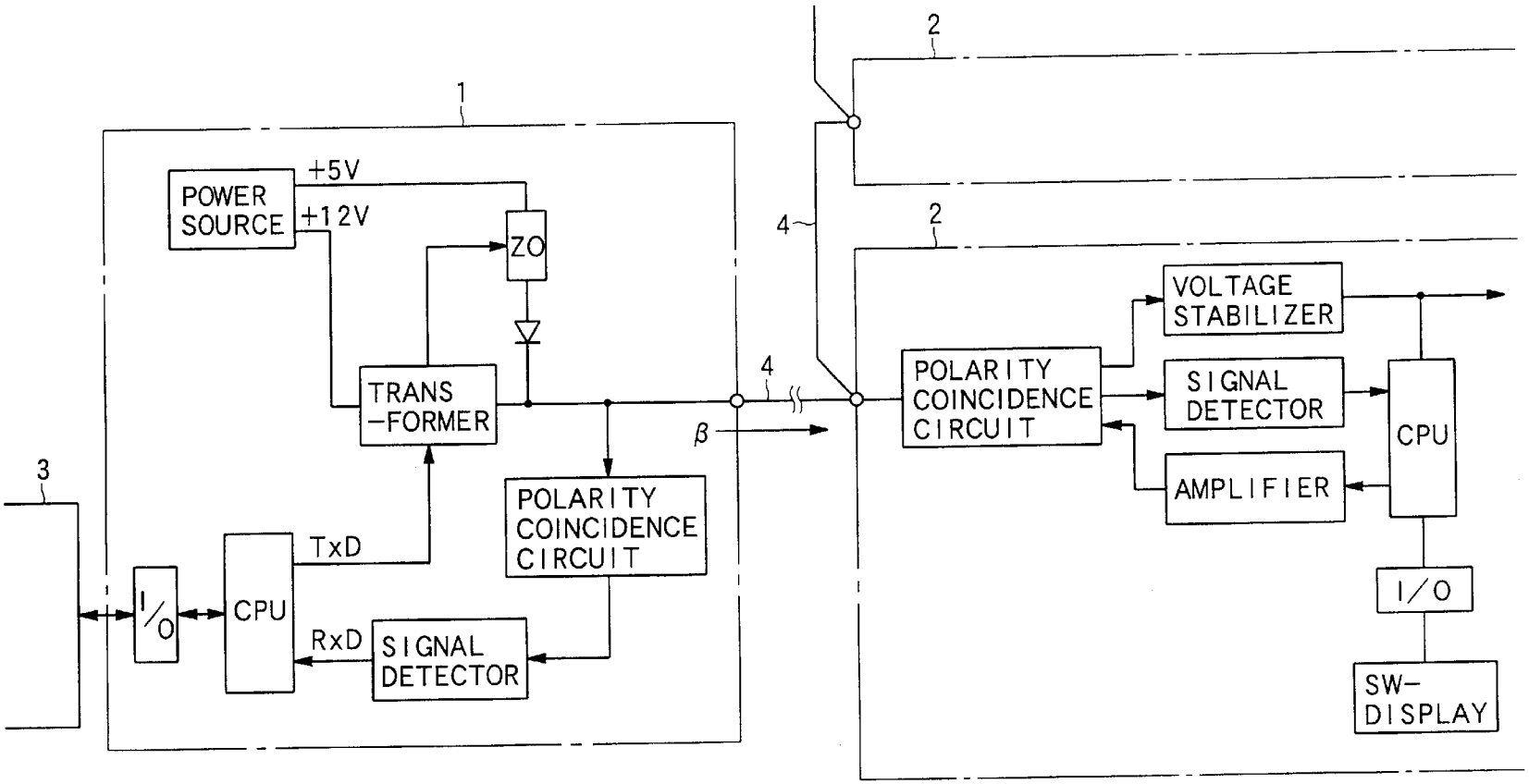
FIG. 1 is a schematic diagram showing a conventional communication controller for an air conditioner.

On the other hand, according to the present invention, the polarity coincidence circuit of the communication controller is designed so that transistors are added to the bridged diodes constituting the polarity coincidence circuit of FIG. 1 as shown in FIG. 4. With this construction, the polarity coincidence circuit 63A can be connected to the power source circuit 59 in series, and also it can be connected to the polarity coincidence circuit 63B of the other equipment in series. That is, the power source and the polarity coincidence circuits of all the indoor units are connected to one another in series.

Accordingly, the transmission/reception of the communication signals and the supply/reception of the power source voltage can be carried out through the polarity coincidence circuits 63A and 63B. Therefore, the communication controllers of all the indoor units can be manufactured in the same construction, and they can be mutually supply/receive power. That is, in the communication control system of this embodiment, the power supply can be mutually performed between the indoor units as shown in FIG. 3 (both the directions indicated by arrows α, β, are possible as the power supply direction). On the other hand, in the conventional communication control system shown in FIG. 1, only one direction as indicated by the arrow β is allowed.

Accordingly, when any indoor unit is used as a power supply source, the other indoor units can receive the power supply from the indoor unit concerned, and also when some trouble occurs in the power supply source concerned, any other indoor unit which can function as a power supply source can be automatically selected and set to function as a power supply source. Therefore, the operation of the air conditioning system can be continuously performed without stopping the air conditioning system until the trouble of the power supply source (master unit) is solved.

FIG. 4 is a specific circuit diagram of the communication controller of each indoor unit shown in FIG. 3.

In the circuit of FIG. 4, the communication superposing circuit 55 shown in FIG. 3 is constructed by resistors R1, R2 and a transistor Q2 surrounded by a dotted line 55, and the polarity coincidence circuit 63A (63B) shown in FIG. 3 is constructed by bridged diodes 53 and transistors Q3, Q4 connected to the connection points of these diodes 53.

As described above, the bridged diodes 53 enable the power source voltage from the external (another indoor unit) to be input therethrough into the communication controller thereof, but cannot supply the self power source voltage therethrough to the external (other equipment). However, according to this embodiment, the transistors Q3 and Q4 (functioning as through-path or bypass transistors to the bridged diodes 53) are provided to enable the self power source voltage to the external. Further, the voltage detecting circuit 56 is constructed by resistors R3, R4 and a transistor Q6, and the over-current detecting circuit 57 is constructed by resistors R1, R5, R6, a capacitor C1 and transistors Q1, Q7.

Next, the communication data transmitting/receiving operation, the power supply start/stop operation, the trouble detecting operation based on short-circuiting of the communication line or the like, the automatic switching operation of the power supply source, etc. in the communication controller thus constructed will be described below with reference to FIG. 4.

In this embodiment, all the equipment (excluding the remote controller, the central controller) connected to the communication line 4 can serve as a power supply source as described above. However, it is unnecessary for all the indoor units to carry out power supply at the same time, and it is sufficient for any one indoor unit to carry out power supply. The indoor unit that starts its function as a power supply source when the main power source is switched on may be preset in the manufacturing stage in advance, or any one indoor unit may be automatically selected under the control of the microcomputer of each indoor unit as described later.

First, (1) the operation of starting the power supply to the communication line will be described.

Here, it is assumed that any one indoor unit is set to play a role as a power supply source when the main power source is switched on. In this case, when the main power source is switched on, the microcomputer 58 of the indoor unit concerned supplies a predetermined signal (ON signal) from the power supply output terminal thereof to switch on the transistor Q5, and thus current flows from the main power source through the transistor Q5. Therefore, the transistor 54 is switched on and the voltage at the connection point P1 (FIG. 4) is set to the power source voltage. The power source voltage cannot be supplied through the bridged diodes 53 to the outside (communication line 4). However, since the transistors Q3 and Q4 are also switched on under the power source voltage at this time, the power source voltage can be supplied through these transistors Q3 and Q4 to the outside and further supplied through the communication line 4 to the other equipment (the other indoor units, the remote controller, the central controller).

On the other hand, in the other equipment (other indoor units), no ON signal is supplied to the power supply output terminal of the microcomputer (i.e., OFF signal is supplied), the transistor 54 is kept to OFF state. However, the power source voltage is supplied from the outside (the indoor unit serving as the power supply source) through the bridged diodes 53, and thus the voltage at the connection point P1 is set to the power source voltage. Accordingly, current flows through the resistors R3, R4 to apply a divided voltage of the power source voltage to the base of the transistor Q6, so that the transistor Q6 is switched on and thus current flows through the input terminal (protection circuit input terminal) of the microcomputer 58.

Now, it is assumed that a logical value of "1" is set when the signal (SA) at the power supply output terminal CH1 is set to an ON signal (with which the transistor Q5 is switched on) and a logical value of "0" is set when the signal (SA) at the power supply output terminal CH1 is set to an OFF signal (with which the transistor Q5 is switched off), and also that a logical value of "1" is set when the signal (SB) at the microcomputer input terminal CH3 is set to an ON signal (with which the transistor Q6 is switched on) and a logical value of "0" is set when the signal (SB) is set to an OFF signal (with which the transistor Q6 is switched off). On the basis of these logical values, the microcomputer 58 makes various judgments. For example, when SA represents "1" and SB represents "1", the microcomputer 58 of the indoor unit concerned judges that the indoor unit thereof functions as a power supply source and supplies the power source voltage to the other equipment. On the other hand, when SA represents "0" and SB represents "1", the microcomputer 58 judges that the indoor unit thereof does not function as a power supply source and it is supplied with the power source voltage from another indoor unit functioning as a power supply source. Likewise, when SA represents "1" and SB represents "0", the microcomputer 58 judges that the indoor unit thereof functions as a power supply source, however, it does supply the power source voltage (the voltage of the contact point P1 is equal to zero or a lower voltage near to zero). In this case, the microcomputer 58 judges that there occurs some trouble such as short-circuiting of the communication line, in-circuit short-circuiting or the like. Further, when SA represents "0" and SB represents "0", the microcomputer 58 judges that the indoor unit thereof is supplied with no power source voltage, that is, any indoor unit functioning as a power supply source does not exist, and thus it outputs the ON signal to the power supply output terminal CH1 so that the indoor unit thereof functions as a power supply source (that is, SA is set to "1").

As described above, a logical circuit can be constructed by the transistors Q5, Q6, the resistors R3, R4, etc. On the basis of the signal (logical value) at the input terminal of the logical circuit (at the power supply output terminal CH1) and the signal (logical value) at the output terminal of the logical circuit (at the protection circuit input terminal), any one indoor unit can be automatically selected as a power supply source (i.e., it judges whether it should become a power supply source or not), and troubles such as short-circuiting, etc. can be detected.

Here, when occurrence of some trouble is detected by the logical circuit and the microcomputer, the microcomputer 58 sets the signal SA to the OFF signal to stop the power supply to the other equipment. If the trouble is solved, the microcomputer may set the OFF signal to the ON signal to resume the power supply to the other equipment. The above logical judgment is carried out by the microcomputer equipped to each indoor unit.

Next, (2) the operation of superposing the communication signal on the power source voltage and outputting the superposed signal to the communication line 4 will be described.

By applying communication signals (ON/OFF signals) from the communication port (output side terminal) Tx of the microcomputer 58 to the transistor Q2, the transistor Q2 is switched on/off. When the indoor unit concerned functions as a power supply source, current flows from the power source +V through the transistor 54 and the diode 60 to the resistors R1 and R2. Accordingly, the voltage at the connection point P1 is modulated on the basis of the communication signals (ON/OFF signals) applied to the transistor Q2, and then output to the outside through the communication line 4. This means that the power source voltage and the communication signals are superposed and then the superposed signals are output to the communication line 4. When the indoor unit concerned does not function as the power supply source, the power source voltage supplied from another indoor unit is depolarized through the bridged diodes 53 and then applied to the connection point P1. Therefore, in this case, the power source voltage at the connection point P1 is also modulated by the communication signals applied to the transistor Q2, and the modulation signals are transmitted through the communication line 4 to the outside.

Next, (3) the operation of receiving the communication signals from the outside (other equipment) will be described.

When the communication signals are input from the outside, these signals are input through the bridged diodes 53 and the connection point P1 to the signal detecting circuit 62 to be subjected to predetermined signal processing, and then input to the communication port (input side) Rx of the microcomputer 58.

Next, (4) the operation of detecting short-circuiting of the communication circuit (line) will be described.

As described above, when the communication circuit (line) is short-circuited, the voltage at the connection point P1 is equal to zero or a low voltage near to zero, so that the transistor Q6 is switched off. At this time, on the basis of the logical circuit, it can be judged whether the communication line is short-circuited or any indoor unit does not function as a power supply source (no power source voltage appears on the communication line 4). If the transistor Q6 is still kept under the off state although the signal at the power supply output terminal CH1 is set to the ON signal under the above state, it is judged that the communication line or the like is short-circuited.

Next, (5) the detecting operation when a negative (reverse)-phase or same-phase power source voltage is applied from another indoor unit through the communication line 4 will be described.

There is a probability that when some indoor unit is set to function as a power supply source and starts the operation of supplying the power source voltage to the communication line, another indoor unit may be set to function as a power supply source and start the power supply operation. In this case, there are considered a case where the other indoor unit supplies the power source voltage having the opposite phase to that of the indoor unit concerned and a case where the other indoor unit supplies the power source voltage having the same phase as that of the indoor unit concerned. First, the former case (negative-phase voltage case) will be described.

When the power source voltage from another indoor unit has the negative (opposite) phase, the voltage on the communication line 4 (or at the connection point P1) is reduced to zero or a lower voltage. At this time, the voltage applied across both the ends of the resistor R1 is increased. If it increases to a predetermined threshold voltage (Vth, for example, 3V) or more, the transistor Q1 is switched on and the transistor Q7 is also switched on, so that the microcomputer 58 judges that the negative-phase voltage is applied (or the communication line is short-circuited). In this case, the transistor Q6 is not switched on because the voltage at the connection point P1 is equal to zero or a lower voltage. Therefore, the microcomputer can also judge the short-circuiting or the application of the negative-phase power source voltage. In this embodiment, the judgement on the application of the negative-phase power source voltage and the short-circuiting of wires (communication line) is made through an OR circuit comprising the transistors Q6 and Q7 by the microcomputer 58, and thus the judgment can be more surely performed.

When the application of the negative-phase power source voltage or the short-circuiting of the communication line is detected, the signal at the power supply output terminal is set to the OFF signal to stop the power supply operation.

On the other hand, when the indoor unit functioning as the power supply source is supplied with the in-phase power source voltage from another indoor unit, the judgment on the in-phase power source voltage cannot be performed by the circuit construction of FIG. 4. However, each indoor unit serving as a power supply source transmits a signal representing the start (execution) of the power supply operation thereof to the other indoor units while superposing the signal on the communication data, and thus the microcomputer of each indoor unit judges on the basis of the communication data whether the in-phase power source voltage is applied to another indoor unit. On the basis of this judgment, the power supply operation is stopped if necessary.

Figure 5:
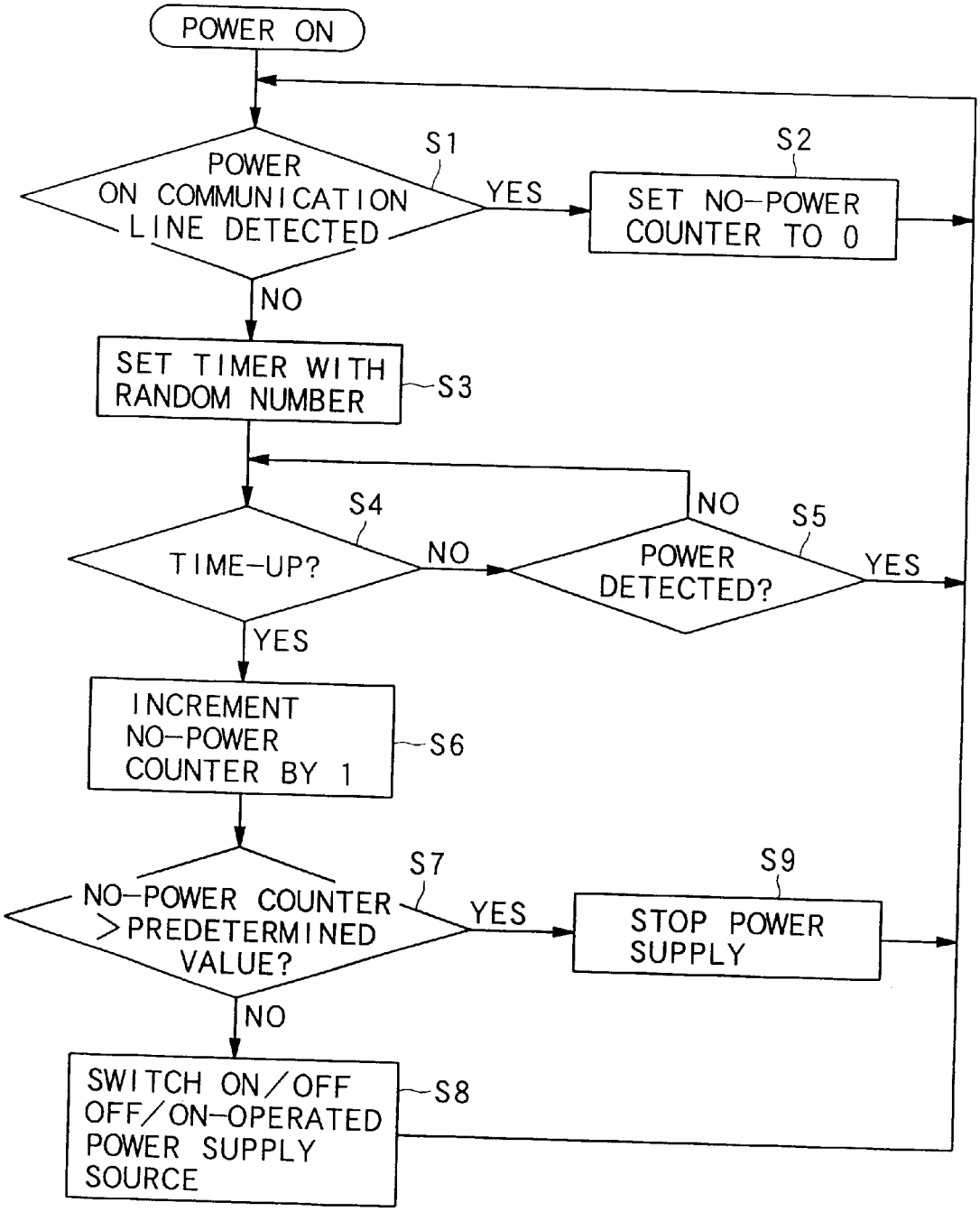
FIG. 5 is a flowchart showing the operating flow of the communication controller used in the air conditioning system according to the present invention.

FIG. 5 is a flowchart showing the flow of the operation of the communication controller (FIGS. 3,4) equipped to each indoor unit.

When the main power source for supplying power source to each indoor unit, etc. is switched on, it is detected whether the power source voltage exists on the communication line (step S1). The detection of the power source voltage is carried out on the basis of the signal level at the protection circuit input of the microcomputer 58 (the ON-operation of the transistor Q6). If the power source voltage has already existed (YES: S1), it is judged that another indoor unit functions as a power supply source, and a communication line no-power counter is set to 0 (step S2). Thereafter, the processing returns to an initial operation (S1).

On the other hand, if no power source voltage exists on the communication line, that is, no power source voltage is detected (no indoor unit supplies power, plural indoor units supply negative(inverse)-phase power source voltages and thus the short-circuiting occurs, or the communication line is under a short-circuit state), each indoor unit sets its timer with a random number (step S3). The setting of the timer on the basis of the random number is carried out to make the time-up time different among the indoor units. Accordingly, the time period for which each indoor unit sets itself as a power supply source and supplies the power source voltage onto the communication line is different among the indoor units. Therefore, the probability that some indoor units set themselves as power supply sources at the same time can be reduced.

Next, it is judged whether the time is up in the timer, that is, whether the time set on the basis of the random number elapses (step 4), If the time is not up, it is detected again whether the power source voltage exists on the communication line (step S5). Here, if the power source voltage on the communication line is detected (i.e., another indoor unit supplies the power source voltage onto the communication line during the timer counting operation of the indoor unit concerned), the processing returns to the initial operation (S1). On the other hand, if no power source voltage on the communication line is detected, the processing returns to the judgment on the time-up (S4).

Here, if it is judged that the time is up, the communication line no-power counter is incremented by 1 (step S6), and it is judged whether the count value is larger than a predetermined value (step S7). If the counter value is not larger than the predetermined value, each indoor unit (power supply source) that supplies the power source voltage stops its power supply operation, and each indoor unit that supplies no power source voltage starts its power supply operation. This operation is carried out because there is a probability that although plural power supply sources supply the power supply voltages, the power source voltages are negative (inverse) phase to one another and thus no power source voltage is detected on the communication line.

On the other hand, it is judged in step S7 that the counter value is larger than the predetermined value, the power supply operation is stopped in step S9. This is because it is judged that the power source voltage cannot be still supplied due to short-circuiting of the communication line or the line although the above operation is carried out at plural times. After the above operation is carried out, the processing returns to the initial operation (step S1).

Any indoor unit that supplies the power source voltage onto the communication line certainly transmits a command representing "there is a power source supplying indoor unit" onto the communication line once per predetermined time (for example, 20 seconds) irrespective of the current situation that the indoor unit is the master or a slave, or the system is stopped or executed. Any indoor unit which receives the above command, excluding the indoor unit issuing the above command, stops the power supply operation.

The present invention is not limited to the above embodiment, and various modifications may be made to the above embodiment. For example, in the above embodiment, the power supply function is limited to the indoor unit, however, it is not limited to only the indoor unit. For example, the outdoor unit may be equipped with the power source supply function.

Further, in the above embodiment, the present invention is applied to the communication control system for an air conditioner including plural indoor units, a remote controller, etc. However, the present invention is not limited to the air conditioning system. That is, the present invention may be applied to any system insofar as the system comprises plural units some of which have a power supply capability and a function of automatically detecting the presence or absence of a power source voltage on a communication line and judging whether the power supply operation thereof should be started or stopped.

As described above, according to the present invention, the communication data (ON/OFF signal) superposed on the power source voltage are transmitted/received through the polarity coincidence circuits among the indoor units, the remote controller and the central controller while passing through the communication line, and a plurality of indoor units or all the indoor units are equipped with a function of automatically selecting itself as a power supply source (self-selecting function). Therefore, even when an indoor unit functioning as a power supply source fails due to some trouble, it is unnecessary to stop the air conditioning system, and another indoor unit is automatically selected as a power supply source, so that the air conditioning system can be operated continuously.

Further, with the simple circuit construction based on the DC ON/OFF circuit, the communication line and the power supply line can be made common, and the non-polarized and bi-directional data communication can be performed while supplying the power from any indoor unit to the control equipment.

Still further, any one indoor unit is automatically selected as a power supply source from plural indoor units. Therefore, it is unnecessary for an equipment service staff member to carry out the initial setting on the air conditioning system, and the present invention can support various system constructions.

Even when another indoor unit supplies a negative (inverse)-phase power source voltage, the power supply operation can be automatically stopped, and thus the system can be avoided from breaking down. Further, when an indoor unit functioning as a power supply source supplies a negative(inverse)-phase power source voltage or the communication line is short-circuited, another indoor unit that can operate normally is automatically searched and switched, so that the air conditioning system can be continuously operated.

In addition, when plural power supply sources supply in-phase power source voltages, only one indoor unit is automatically selected as the power supply source, so that the control equipment can be prevented from receiving excessively high power.

Further, since the present invention uses transistors in place of generally-used diodes, the circuit construction can be simplified.

What is claimed is:

1. The communication control system as claimed in claim for an air conditioner including at least one outdoor unit, plural indoor units and control equipment such as a remote controller, etc. which are connected to one another through a communication line to mutually carry out data communication through said communication line, characterized in that at least two indoor units of said plural indoor units are equipped with power supply means, and non-polarized and bi-directional data communication is carried out between said plural indoor units and said control equipment while said power supply means of any one of said at least two indoor units supplies a power source voltage of a main power source to said communication line to said control equipment, wherein said power supply means includes a voltage detecting unit for detecting the power source voltage on said communication line, and a logical unit for judging on the basis of the detection result of said voltage detecting unit whether there is another power supply source which supplies the power source voltage onto said communication line and setting itself to function as a power supply source if it is judged that no other power supply source exists.

2. The communication control system as claimed in claim 1, wherein said power supply means includes a communication superposing unit for superposing communication data on the power source voltage, a switching unit for ON/OFF-controlling the supply of the power source voltage from said main power source to said communication superposing unit, and a polarity coincidence unit for passing therethrough the output of said communication superposing unit to said communication line and depolarizing the power source voltage through said communication line from another indoor unit functioning as a power supply source.

3. The communication control system as claimed in claim 2, wherein said communication superposing unit includes a transistor to which ON/OFF signals of communication signals are input, and at least two resistors that are connected to each other in series and divides the power source voltage from said main power source in accordance with the ON/OFF operation of said transistor to superpose the communication signals on the power source voltage.

4. The communication control system as claimed in claim 2, wherein said switching unit is disposed between said main power source and said communication superposing unit, and equipped with a transistor for ON/OFF-controlling the supply of the power source voltage from said main power source to said communication superposing unit on the basis of the ON/OFF operation thereof.

5. The communication control system as claimed in claim 2, wherein said polarity coincidence unit includes bridged diodes for converting the polarity of signals from the external, and a transistor for bypassing the output signal of said communication superposing unit without passing the output signal through said bridged diodes.

6. The communication control system as claimed in claim 2, wherein said power supply unit further includes a voltage detecting unit for detecting the power source voltage in said communication superposing unit.

7. The communication control system as claimed in claim 1, wherein said power supply means further includes a logical unit for logically judging it on the basis of communication data transmitted through said communication line whether the supply of the power source voltage is stopped or not when another indoor unit functioning as a power supply source supplies an in-phase power source voltage.

8. The communication control system for an air conditioner including at least one outdoor unit, plural indoor units and control equipment such as a remote controller, etc. which are connected to one another through a communication line to mutually carry out data communication through said communication line, characterized in that at least two indoor units of said plural indoor units are equipped with power supply means, and non-polarized and bi-directional data communication is carried out between said plural indoor units and said control equipment while said power supply means of any one of said at least two indoor units supplies a power source voltage of a main power source to said communication line to said control equipment, wherein said power supply means includes a communication superposing unit for superposing communication data on the power source voltage, a switching unit for ON/OFF-controlling the supply of the power source voltage from said main power source to said communication superposing unit, and a polarity coincidence unit for passing therethrough the output of said communication superposing unit to said communication line and depolarizing the power source voltage through said communication line from another indoor unit functioning as a power supply source, wherein said power supply unit further includes an over-current detecting unit that is disposed between said switching unit and said communication superposing unit and detects the variation of the power source voltage applied to said communication superposing unit to detect short-circuiting of said communication line.

9. The communication control system as claimed in claim 8, wherein said over-current detecting unit includes at least one resistor, and a transistor which is switched on/off on the basis of the voltage applied to both the ends of said resistor, a voltage value applied to both the end of said resistor being varied in accordance with the variation of the power source voltage, and said transistor being switched on/off when the voltage value exceeds a predetermined voltage value, thereby detecting the short-circuiting of said communication line.

10. The communication control system for an air conditioner including at least one outdoor unit, plural indoor units and control equipment such as a remote controller, etc. which are connected to one another through a communication line to mutually carry out data communication through said communication line, characterized in that at least two indoor units of said plural indoor units are equipped with power supply means, and non-polarized and bi-directional data communication is carried out between said plural indoor units and said control equipment while said power supply means of any one of said at least two indoor units supplies a power source voltage of a main power source to said communication line to said control equipment, wherein said power supply means includes a communication superposing unit for superposing communication data on the power source voltage, a switching unit for ON/OFF-controlling the supply of the power source voltage from said main power source to said communication superposing unit, and a polarity coincidence unit for passing therethrough the output of said communication superposing unit to said communication line and depolarizing the power source voltage through said communication line from another indoor unit functioning as a power supply source;

wherein said power supply unit further includes a voltage detecting unit for detecting the power source voltage in said communication superposing unit;

wherein said voltage detecting unit includes at least two resistors connected in series, and a transistor connected to the connection point of said two resistors, the power source voltage being applied to one terminal of one of said two resistors at the opposite side to said connection point while one terminal of the other resistors at the opposite side to said connection point is grounded, and the power source voltage being detected on the basis of the ON/OFF operation of said transistor which is switched on/off on the basis of the voltage at the connection point of said two resistors.

11. The communication control system for an air conditioner including at least one outdoor unit, plural indoor units and control equipment such as a remote controller, etc. which are connected to one another through a communication line to mutually carry out data communication through said communication line, characterized in that at least two indoor units of said plural indoor units are equipped with power supply means, and non-polarized and bi-directional data communication is carried out between said plural indoor units and said control equipment while said power supply means of any one of said at least two indoor units supplies a power source voltage of a main power source to said communication line to said control equipment, wherein said power supply means includes a detection unit for detecting simultaneous application of a negative-phase power source voltage from another indoor unit functioning as a power supply source onto said communication line or short-circuiting of said communication line, and then stopping the supply of the power source voltage if the simultaneous application of the negative-phase power source voltage from the other indoor unit is detected.

12. The communication control system as claimed in claim 11, wherein said power supply means resumes the supply of the power source voltage after the supply of the power source voltage is stopped.

13. The communication control system for an air conditioner including at least one outdoor unit, plural indoor units and control equipment such as a remote controller, etc. which are connected to one another through a communication line to mutually carry out data communication through said communication line, characterized in that at least two indoor units of said plural indoor units are equipped with power supply means, and non-polarized and bi-directional data communication is carried out between said plural indoor units and said control equipment while said power supply means of any one of said at least two indoor units supplies a power source voltage of a main power source to said communication line to said control equipment, wherein said power supply means of each of said at least two indoor units is equipped with self-selecting means for automatically selecting itself as a power supply source for supplying the power source voltage to said communication line.

14. A communication control system for an air conditioner including plural indoor units and at least one outdoor unit, each indoor unit and control equipment containing a remote controller being connected to each other through a communication line, characterized in that at least two indoor units of said plural indoor units are equipped with a power supply means and further characterized in that all said indoor units and said control equipment perform non-polarized and bi-directional data communication while a power source voltage is applied from any one of said plural indoor units to said control equipment, wherein said power supply means includes a voltage detecting unit for detecting the power source voltage on said communication line, and a logical unit for judging on the basis of the detection result of said voltage detecting unit whether there is another power supply source which supplies the power source voltage onto said communication line and setting itself to function as a power supply source if it is judged that no other power supply source exists.

* * * * *